US006078168A

United States Patent [19]

Paolo

[11] Patent Number: 6,078,168

[45] Date of Patent: Jun. 20, 2000

[54] PARALLEL VOLTAGE REGULATOR

[75] Inventor: Migliavacca Paolo, Grenoble, France

[73] Assignee: SGS-Thomson Microelectronics S.A., Gentilly, France

[21] Appl. No.: 08/991,317

[22] Filed: Dec. 16, 1997

[30] Foreign Application Priority Data

Dec. 17, 1996 [FR] France ..... 96 15911

[51] Int. Cl.[7] ..... G05F 1/613; G05F 3/16; G05F 3/02

[52] U.S. Cl. ..... 323/226; 323/316; 327/538

[58] Field of Search ..... 323/226, 316, 323/907, 280, 269, 281; 327/538

[56] References Cited

U.S. PATENT DOCUMENTS

| | | | |
|---|---|---|---|
| 3,671,770 | 6/1972 | Frederiksen | 323/281 |
| 3,851,241 | 11/1974 | Wheatley | 323/226 |
| 4,017,788 | 4/1977 | Stepp et al. | 323/226 |
| 4,055,774 | 10/1977 | Ahmed | 323/316 |
| 4,103,219 | 7/1978 | Wheatley, Jr. | 323/8 |
| 4,282,477 | 8/1981 | Ahmed | 323/312 |
| 4,325,017 | 4/1982 | Schade, Jr. | 323/313 |

FOREIGN PATENT DOCUMENTS

| | | | |
|---|---|---|---|
| 2 226 664 | 7/1990 | United Kingdom | G05F 1/613 |

*Primary Examiner*—Adolf Deneke Berhane
*Assistant Examiner*—Rajnikant B. Patel
*Attorney, Agent, or Firm*—Wolf, Greenfield & Sacks, P.C.; James H. Morris; Theodore E. Galanthay

[57] ABSTRACT

The present invention relates to a voltage regulator for connection in parallel to a load, including a circuitry for generating a temperature-stable reference voltage; a controllable circuit for branching a portion of a current meant for the load; a circuit for regulating the branched current according to the current absorbed by the load; and a circuit for controlling a regulation circuit supply current with the current branched by the branching means.

29 Claims, 2 Drawing Sheets

PARALLEL VOLTAGE REGULATOR

BACKGROUND OF THE INVENTION

1. Field of the Invention

The present invention relates to a voltage regulator meant to be connected in parallel to a load for maintaining a supply voltage of the load at a predetermined value even in case of variation of the current surged or drawn by the load. The present invention more specifically relates to a regulator which supplies a reference voltage independent from the temperature and generated by a circuit in bipolar technology using the forbidden band of silicon.

2. Discussion of the Related Art

FIGS. 1 and 2 show two conventional examples of association of such a regulator with a load.

The regulator (REG) 1 generally includes two supply terminals, respectively a positive terminal K and a negative terminal A, and a terminal Vref providing a reference voltage stable in temperature. For a positive voltage regulator, terminal K is connected to a supply terminal V+ via a resistor R1 and terminal A is connected to the ground. The load (Q) 2 is connected to terminals K and A.

The function of regulator 1 is to vary the current taken by the regulator from node K to maintain voltage $V_{KA}$ constant during variations of the current surged or drawn by load 2. The current 1 taken from the supply is substantially constant, only its distribution between load 2 and regulator 1 is modified.

In the example of FIG. 1, terminal Vref is connected to terminal K, load 2 being meant to be supplied under a voltage $V_{KA}$ corresponding to voltage Vref.

In the example of FIG. 2, a resistive dividing bridge formed by resistors R2, R3, connected in series between terminals K and A determines, with resistor R1, a coefficient of proportionality between voltage Vref and load supply voltage $V_{KA}$. The midpoint of the association of resistors R2, R3, is connected to terminal Vref of regulator 1.

A problem which arises in this type of regulator is related to the current operating range of the regulator, that is, the range of currents in which the regulator is capable of maintaining voltage $V_{KA}$ substantially constant.

FIG. 3 shows an example of conventional diagram of a regulator 1 such as shown in FIGS. 1 and 2.

Regulator 1 includes a circuit 3 for generating temperature compensated reference voltage Vref, a branching stage 5 taking a current Is from terminal K and a differential stage 4 for regulating current Is according to the current in the load (not shown in FIG. 3).

Circuit 3 is formed of an NPN transistor N1 mounted in series with three resistors R4, R5, R6, between terminals K and A. The collector of transistor N1 is connected to terminal K and its base forms terminal Vref Circuit 3 also includes a differential stage formed of two PNP transistors P2, P3, the emitters of which are connected to terminal K via a source 6 of constant current, and the collectors of which are connected to terminal A via biasing and gain adjusting resistors R7, R8, R9. The respective bases of transistors P2 and P3 are connected to the terminals of resistor R5 which forms the intermediary resistor of the series association of resistors R4, R5, and R6 between the emitter of transistor N1 and terminal A.

The operation of circuit 3 is well known. The difference ΔVbe between the respective base-emitter voltages Vbe2 and Vbe3 of transistors P2 and P3 is directly proportional to temperature. The voltage across the series association of resistors R4, R5, and R6 (thus, the voltage between the emitter of transistor N1 and terminal A) is also proportional to temperature. Conversely, base-emitter voltage Vbe1 of transistor N1 is inversely proportional to temperature. Thus, voltage Vref is stable in temperature.

The collectors of transistors P2 and P3 are connected to the respective bases of two PNP transistors P4 and P5 of stage 4. The emitters of transistors P4 and P5 are connected to terminal K via a source 7 of constant current. The collectors of transistors P4 and P5 are connected to the respective collectors of NPN transistors N6 and N7, the emitters of which are connected to terminal A and the bases of which are connected to the collector of transistor N6. The collector of transistor N7 forms an output of stage 4 which provides a current I5 for controlling an NPN transistor N8 of stage 5. The collector of transistor N8 is connected, possibly via a Darlington assembly forming a current amplifier 8, to the base of an NPN transistor N9 forming a branching transistor mounted between terminals K and A. The emitters of transistors N8 and N9 are connected to terminal A. The amplifying coefficient (−X) brought in by Darlington assembly 8 has been indicated as negative to symbolize the inversion of the current direction between the base current of transistor N9 and the collector current of transistor N8. The collector of transistor N8 is connected to terminal K through a current source 12.

Assuming that the current surged by the load decreases, current I (FIGS. 1 and 2) arriving on terminal K tends to decrease. As a result, voltage $V_{KA}$, and thus voltage Vref, tends to increase. This leads to circulation of a current in the base of transistor N1 and to the circulating of a current It through resistor R5. The voltage difference ΔVbe between the bases of transistors P3 and P2 becomes positive. The unbalance of the collector currents of transistors P3 and P2 generates a positive voltage difference ΔV between the bases of transistors P5 and P4, which causes an increase of current I5 and, thereby, an increase of current Is which restores the balance of the total current I taken on terminal K to compensate the current surge decrease in the load.

To maintain voltage Vref constant, the unbalance of the currents of the collectors of transistors P2 and P3 must be as low as possible. This requires that value ΔV is the lowest possible, that is, base current I5 of transistor N8 remains negligible with respect to current I4 of current source 7 in the variation range of current Is. Indeed, the higher the ratio between current I5 and current I4 (more precisely, the ratio between current I5 and half current I4 due to its distribution between the two branches of stage 4), the more value ΔV causes an important unbalance between the base currents of transistors P2 and P3 and the more voltage Vref drifts.

The operating range of the regulator is thus linked to the range of current Is in which base current I5 of transistor N8 remains low with respect to current I7.

The role of amplifying assembly 8 is precisely to bring in a gain factor between current I5 and base current Ib9 of transistor N9. The gain of the assembly, linked to the number of Darlington stages that it includes, must however remain limited in order not to generate a stability problem of the control loop caused by too much gain.

As a particular example, the variation of the voltage Vref of a regulator such as shown in FIG. 3, sized for an intrinsic consumption (that is, without taking branching current Is into account) of about 50 μA, is about 330 μV per milliamperes of variation of current Is. The maximum operating current Is of such a regulator, to maintain reference voltage Vref plus or minus one centivolt, is then around 15 mA.

A conventional solution to increase the range of current in which the regulator maintains voltage Vref is to increase the size of transistors forming current source 7, in order to increase, permanently, current I4 of supply of regulation stage 4, and, thus, the collector currents of transistors P4 and P5.

A disadvantage of such a solution is that it increases the intrinsic power consumption of the regulator. As a result, if the upper limit of the current operating range is higher, the minimum operating range of the regulator is also higher.

More generally, the problems discussed hereabove arise for any differential stage having a non-differential output connected at the output of a differential amplifier.

SUMMARY OF THE INVENTION

The present invention aims at providing a new parallel regulator having a wider current operating range while maintaining the reference voltage substantially constant.

The present invention also aims at providing a regulator of low intrinsic consumption.

The present invention also aims at maintaining the control loop stable.

The present invention further aims at providing a novel structure of stage with differential inputs and a non-differential output.

To achieve these and other objects, the present invention provides a voltage regulator for connection in parallel to a load, including a means for generating a temperature-stable reference voltage; a controllable means for branching a portion of a current meant for the load; a means for regulating the branched current according to the current absorbed by the load; and a means for controlling supply current with the current branched by the branching means.

According to an embodiment of the present invention, the control means includes a means for copying a control current of the branching means and a means for reinjecting the copied current, assigned with a positive factor, into the supply current of the regulation means.

According to an embodiment of the present invention, the copying means is formed of a first bipolar transistor connected as a current mirror on an input transistor of the branching means receiving the control current.

According to an embodiment of the present invention, the regulation means is formed of a differential stage, on a branch of which the control current of the branching means is taken, the differential stage being supplied by a source of constant current, a correction current proportional to the control current being added to the constant current issued by the current source.

According to an embodiment of the present invention, the reinjection means is formed of a second bipolar transistor, connected as a diode and in series with the first transistor, and of a third bipolar transistor, connected as a current mirror on the second transistor and in parallel on the current source.

According to an embodiment of the present invention, the current mirror comprising the reinjection means has a factor higher than or equal to one.

According to an embodiment of the present invention, the means for generating the reference voltage includes a differential stage, an output of which forms a differential input of the regulation means, and a differential input of which receives a voltage proportional to a variation of the reference voltage.

According to an embodiment of the present invention, the branching means includes a branching transistor connected in parallel with the load, this transistor being controlled by an assembly for amplifying the control current issued by the regulation means.

The present invention also provides a differential stage receiving as an input a differential control voltage and providing an output current taken on a branch of the differential stage, and including a means for controlling a supply current of the differential stage with the output current of this stage.

According to an embodiment of the present invention, the differential stage is associated with a source of constant supply current, and the control means includes a means for adding a correction current to the current issued by the current source, the correction current being obtained by copying and amplifying of the output current of the differential stage.

The foregoing objects, features and advantages of the present invention, will be discussed in detail in the following non-limiting description of specific embodiments in connection with the accompanying drawings.

DETAILED DESCRIPTION

Figure 1:
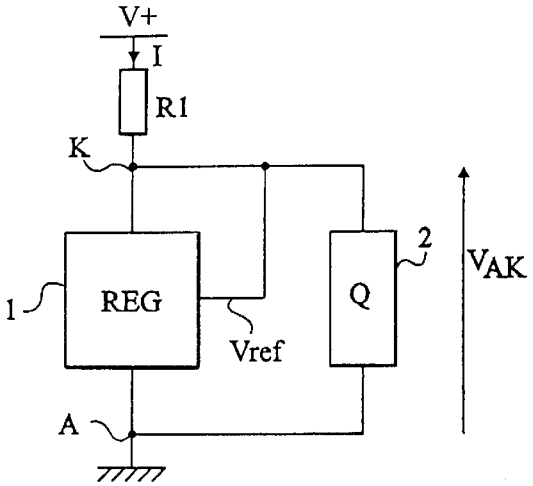
FIGS. 1 to 3 previously described are meant to show the state of the art and the problem to be solved.

The same elements have been referred to with the same reference numbers in the different drawings. For clarity, only those elements necessary to the understanding of the present invention have been shown in the drawings and will be described hereafter.

A characteristic of the present invention is to control the currents flowing in the branches of a differential stage with the output current of this stage. For this purpose, the present invention provides to control the supply current of a differential stage with the non-differential output current of this stage.

Figure 4:
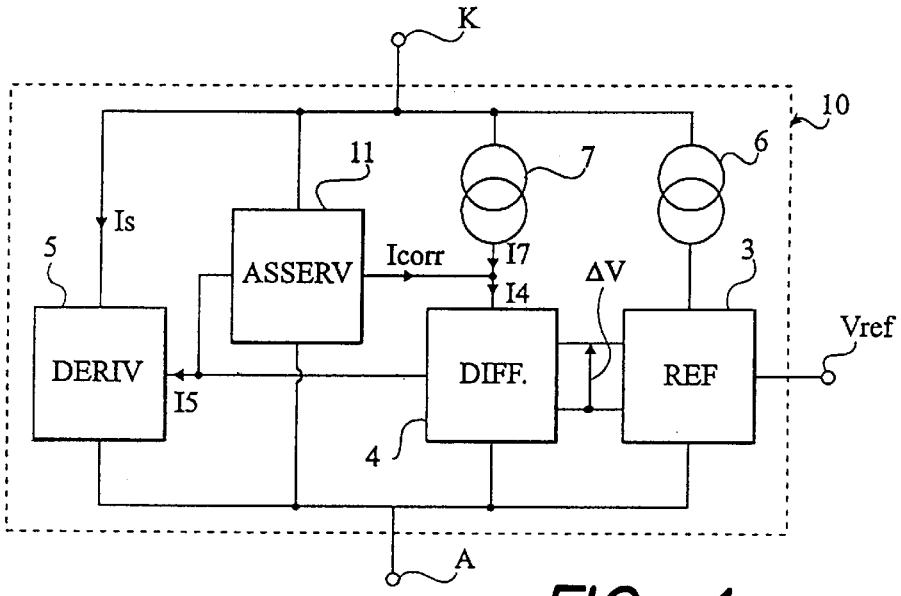
FIG. 4 shows, in the form of a block diagram, an embodiment of a parallel regulator according to the present invention.

FIG. 4 shows, in the form of a block diagram, an embodiment of a voltage regulator according to the present invention, meant to be connected in parallel with a load (not shown).

Figure 2:
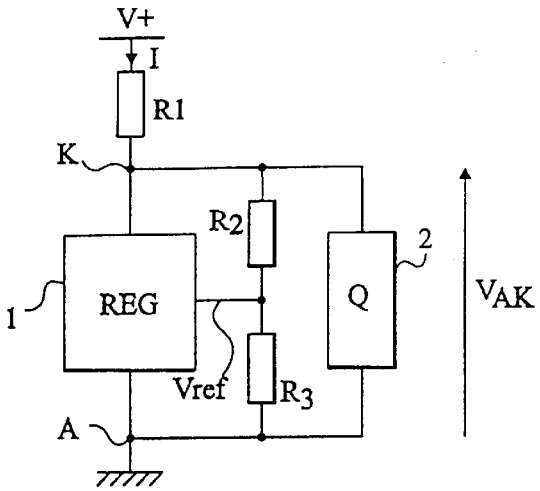

As previously discussed, regulator 10 includes two supply terminals, respectively a positive terminal K and a negative terminal A, and a terminal Vref issuing a reference voltage. The regulator according to the present invention is meant to be associated with a load in the same way as a conventional regulator such as shown in FIGS. 1 and 2.

The regulator includes, as in a conventional regulator, a circuit (REF) 3, associated with a current source 6 and providing a temperature-stable reference voltage Vref, a differential output stage (DIFF) 4 associated with a current source 7, and a stage (DERIV) 5 for branching part of the current, provided on terminal K and meant for a load connected between terminals K and A.

According to the present invention, regulator 10 further includes a circuit (ASSERV) 11 meant for controlling a current I4 of supply of regulation stage 4 with a current I5, provided by this stage 4 for controlling branching stage 5.

According to the present invention, circuit 11 copies current I5, amplifies it, and adds a correction current Icorr to the current I7 issued by constant current source 7 to control current I4 with current I5.

An advantage of the present invention is that its implementation does not require an increase in the size of current source 7 and thus does not cause any increase of the intrinsic consumption of the regulator. Thus, the lower current operating limit of the regulator according to the present invention is substantially unaltered by the addition of circuit 11.

Another advantage of the present invention is that it has no effect over the control loop of voltage Vref. Thus, the present invention enables increasing the operating range of the regulator while maintaining the stability of the control loop.

Figure 3:
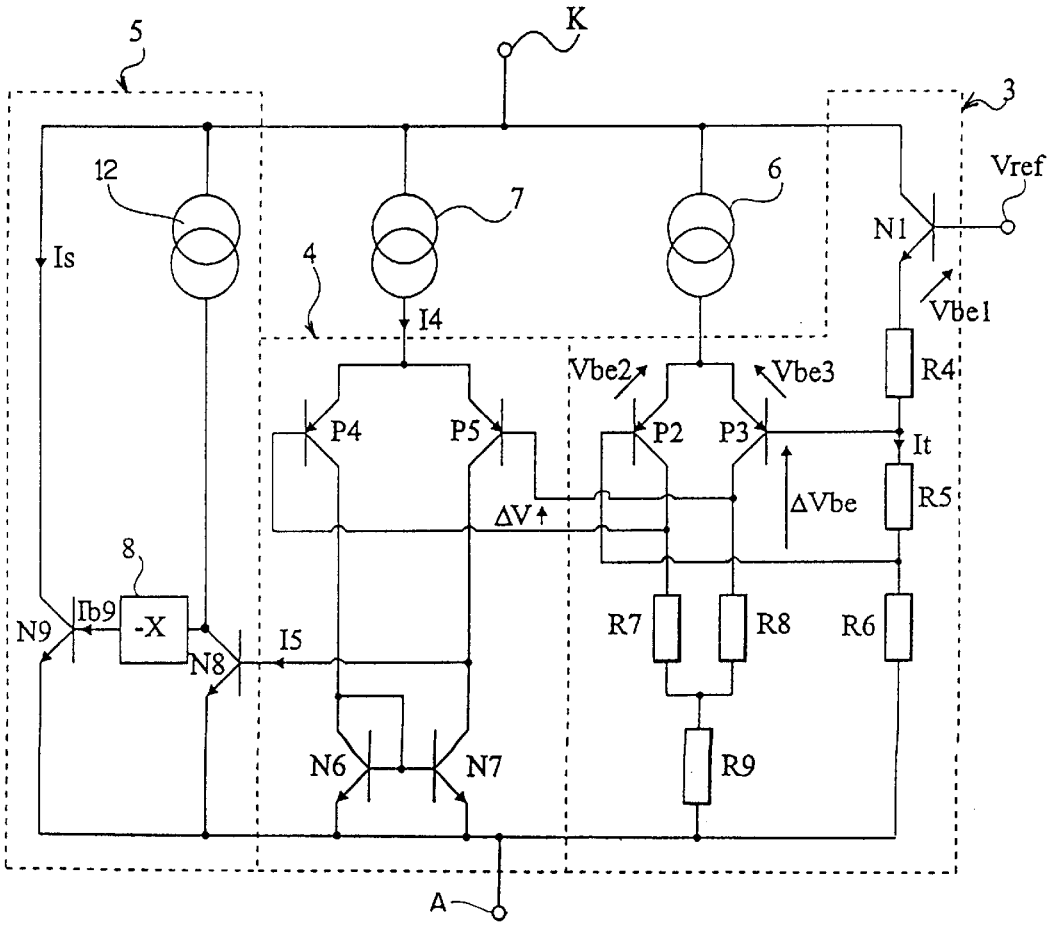
Figure 5:
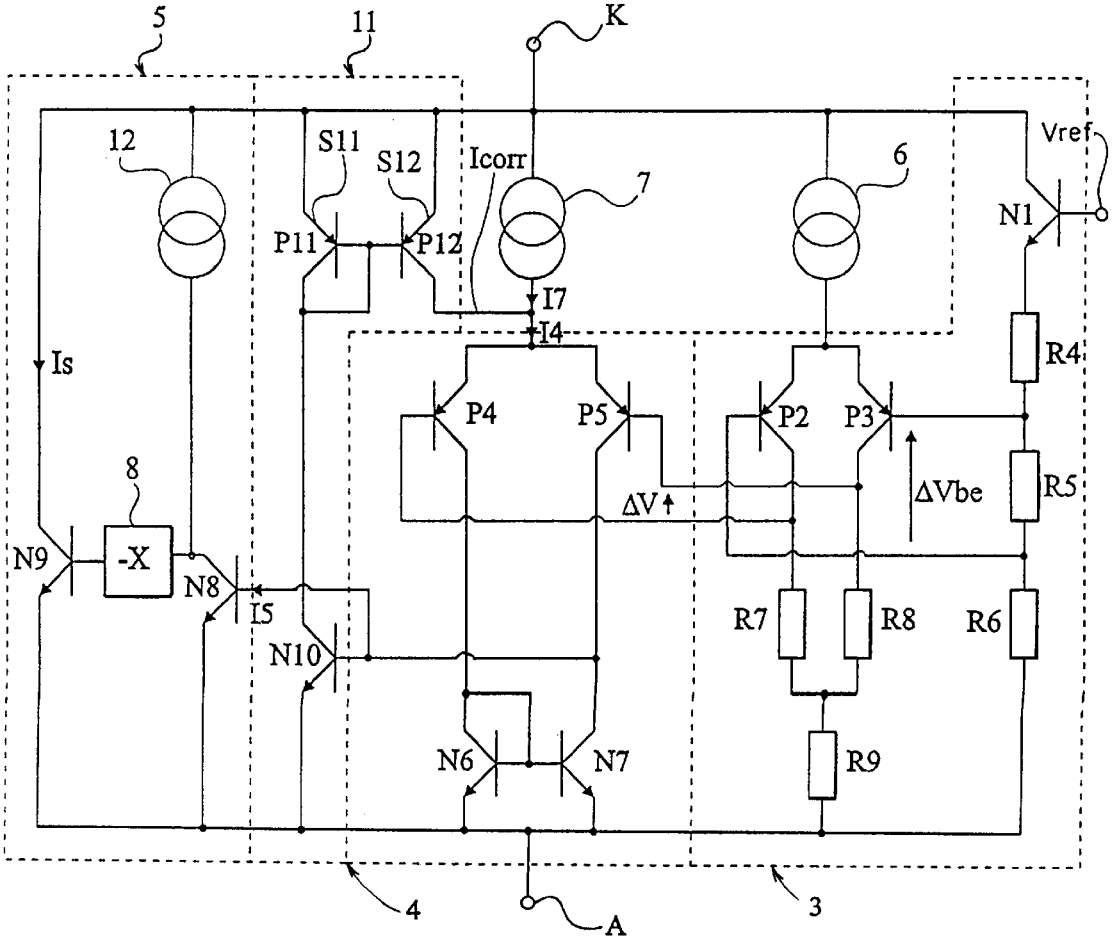
FIG. 5 shows in more detail an electrical schematic diagram of the regulator shown in FIG. 4.

FIG. 5 shows a detailed schematic electric diagram of a voltage regulator shown in FIG. 4. Stages 3, 4, and 5 are similar to those of a conventional regulator such as shown in FIG. 3.

According to the present invention, circuit 11 for controlling current I4 of regulation stage 4 is formed of an NPN transistor N10 connected as a current mirror on input transistor N8 of the branching stage. The emitter of transistor N10 is connected to terminal A and its base is connected to the base of transistor N8. The collector of transistor N10 is connected to the collector of a PNP transistor P11, connected as a diode and the emitter of which is connected to terminal K. A PNP transistor P12 is connected as a current mirror on transistor P11. The emitter of transistor P12 is connected to terminal K and its collector provides correction current Icorr by being connected to the emitters of transistors P4 and P5 of stage 4.

When current I5 of the base of transistor N8 varies, this variation is amplified, at least by the gain of transistor P12 to vary, proportionally, correction current Icorr. The ratio between respective surface areas S12 and S11 of transistors P12 and P11 can be higher than 1 to increase the proportionality factor between current Icorr and current I5.

The emitter currents of transistors P4 and P5 thus correspond to current I7 plus current Icorr which is proportional to current I5 with a high positive proportionality factor which corresponds, at minimum, to the gain of a bipolar transistor. Accordingly, current I5 is rendered permanently negligible with respect to the collector currents of transistors P4 and P5, which maintains voltage difference $\Delta V$ between the bases of transistors P4 and P5 substantially equal to zero. Thus, voltage Vref is maintained substantially constant, the collector currents of transistors P2 and P3 of the differential stage of circuit 3 being substantially balanced.

According to the present invention, the size of transistors P4 and P5 depends on the current operating range chosen for the regulator. Conversely, the size of current source 7 is not modified with respect to a conventional circuit so that the intrinsic minimum consumption of the regulator is low.

It should be noted that the addition of transistors P11 and P12 does not increase the minimum power consumption of the regulator (even though the size of transistor P12 is larger than that of transistor P11 for a mirror factor higher than 1), since the current taken by transistors P11 and P12 from terminal K depends on the magnitude of the branching current Is taken.

The practical implementation of an amplifying assembly 8 is within the abilities of those skilled in the art, by using a Darlington assembly of bipolar transistors. Similarly, the practical implementation of current sources 6 and 7 is within the abilities of those skilled in the art. Bipolar transistors connected as a current mirror could, for example, be used. It should be noted that if current sources 6 and 7 have been shown as common sources for a pair of transistors, respectively P2, P3, and P4, P5, each branch of a differential stage can be associated with a bipolar transistor forming its current source.

To compare the results obtained by means of a regulator according to the present invention such as shown in FIG. 5 with the results obtained with a conventional regulator such as shown in FIG. 3, and assuming that identical components are used except for transistors P4 and P5 which are of larger size in the regulator according to the present invention, the variation of voltage Vref becomes about 30 $\mu$V per milliampere of variation of current Is.

The upper limit of the current operating range can thus be increased and/or the consumption of the regulator can be decreased, that is, the lower operating limit of the regulator can be lowered.

Of course, the present invention is likely to have various alterations, modifications, and improvements which will readily occur to those skilled in the art. In particular, although the present invention has been described hereabove in relation with an application to a current regulator meant to be connected in parallel to a load, the present invention applies, more generally, to any differential stage having a non-differential output, mounted at the output of a differential amplifier. Further, the sizing of the components of the regulator according to the present invention depends on the application for which it is meant, and especially on the desired operating range. Further, although reference has been made in the foregoing description to a positive voltage regulator, the present invention also applies to a negative voltage regulator.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A voltage regulator for connection in parallel to a load, including:

a means for generating a temperature-stable reference voltage;

a controllable means for branching a portion of a current meant for the load; and a regulation means for regulating the branched current according to the current absorbed by the load, and including a means for controlling a supply current of the regulation means with the current branched by the branching means.

2. The regulator of claim 1, wherein the control means includes:

a means for copying a control current of the branching means; and a means for reinjecting the copied current, assigned with a positive factor, into the supply current of the regulation means.

3. The regulator of claim 2, wherein the copying means is formed of a first bipolar transistor connected as a current mirror on an input transistor of the branching means receiving the control current.

4. The regulator of claim 2, wherein the regulation means is formed of a differential stage, on a branch of which the control current of the branching means is taken, the differential stage being supplied by a source of constant current, a correction current proportional to the control current being added to the constant current issued by the current source.

5. The regulator of claim 4, wherein the reinjection means is formed of a second bipolar transistor, connected as a diode and in series with the first transistor, and of a third bipolar transistor, connected as a current mirror on the second transistor and in parallel on the current source.

6. The regulator of claim 5, wherein the current mirror comprising the reinjection means has a factor greater than or equal to one.

7. The regulator of claim 1, wherein the means for generating the reference voltage includes a differential stage, an output of which forms a differential input of the regulation means, and a differential input of which receives a voltage proportional to a variation of the reference voltage.

8. The regulator of claim 1, wherein the branching means includes a branching transistor connected in parallel with the load, this transistor being controlled by an assembly for amplifying the control current issued by the regulation means.

9. A differential stage receiving a supply current and, as an input, a differential control voltage and providing an output current taken on a branch of the differential stage, and including a means for controlling the supply current of the differential stage with the output current of this stage, wherein the control means includes a means for adding a correction current to a current issued by a current source to form the supply current, the correction current being obtained by copying and amplifying of the output current of the differential stage.

10. A voltage regulator comprising:

a reference circuit for establishing a reference voltage;

a differential output stage for providing voltage signals for the reference circuit;

a branching stage for branching a portion of a current meant for a load;

and a control circuit coupled to the differential output stage and for controlling a supply current of the differential output stage and in accordance with the current branched by said branching stage.

11. A voltage regulator according to claim 10, wherein said reference circuit establishes a temperature-stable reference voltage.

12. A voltage regulator according to claim 10, where said differential output stage includes a circuit regulating branched current according to the current absorbed by the load.

13. A voltage regulator according to claim 10, wherein said control circuit includes a circuit for copying a control current of the branching stage.

14. A voltage regulator according to claim 13, wherein said control circuit further includes a circuit for reinjecting the copied current, assigned with a positive factor, into the supply current of the differential output stage.

15. A volt age regulator according to claim 14, wherein the copying circuit if formed of a first bipolar transistor connected as a current mirror on an input transistor of the branching stage receiving the control current.

16. A voltage regulator according to claim 10, wherein the differential output stage comprises a differential stage, on a branch of which the control current of the branching stage is taken.

17. A voltage regulator according to claim 16, wherein said differential stage is supplied by a source of constant current, a correction current proportional to the control being added to the constant issued by the current source.

18. A voltage regulator according to claim 17, wherein said control circuit includes a first transistor and a second transistor said second transistor being a bipolar transistor connected as a diode and in series with said first transistor.

19. A voltage regulator according to claim 18, further including a third bipolar transistor connected as current mirror on the second transistor and at parallel with the current source.

20. A voltage regulator according to claim 19, wherein the current mirror has a factor greater than or equal to 1.

21. A voltage regulator according to claim 10, wherein said reference circuit for generating the reference voltage includes a differential stage, on output of which forms a differential input of the differential output stage.

22. A voltage regulator according to claim 21, wherein said differential stage comprises a pair of light conductivity transistors.

23. A voltage regulator according to claim 22 and further including a current source in series with said differential stage.

24. A voltage regulator according to claim 10, wherein said branching stage includes a branching transistor connected in parallel with the load.

25. A voltage regulator according to claim 24, wherein said branching transistor is controlled by an assembly for amplifying the control current provided by the differential output stage.

26. A voltage regulator according to claim 10, further including a first current source associated with said differential output stage and a second current source associated with said reference circuit.

27. A voltage regulator according to claim 10, wherein said branch stage comprises first and second bipolar transistors interconnected in series.

28. A voltage regulator according to claim 27, further including an amplifying assembly coupled between said first and second bipolar transistors.

29. A voltage regulator according to claim 28, further including a current source coupled to one of said pair of bipolar transistors.

* * * * *

UNITED STATES PATENT AND TRADEMARK OFFICE

CERTIFICATE OF CORRECTION

PATENT NO. : 6,078,168
DATED : June 20, 2000
INVENTOR(S) : Paolo Migliavacca

It is certified that error appears in the above-identified patent and that said Letters Patent is hereby corrected as shown below:

Title page,
Item [19] should read as follows: United State Patent [19] Migliavacca
Item [75] should read as follows: [75] Inventors: Paolo Migliavacca, Grenoble, France Signed and Sealed this Seventh Day of August, 2001

*Attest:*

Nicholas P. Godici

*Attesting Officer*

NICHOLAS P. GODICI
*Acting Director of the United States Patent and Trademark Office*